US007131287B2

(12) United States Patent
Uselton

(10) Patent No.: US 7,131,287 B2
(45) Date of Patent: Nov. 7, 2006

(54) AIR CONDITIONING SYSTEM WITH VIBRATION DAMPENING DEVICE

(75) Inventor: Robert B. Uselton, Plano, TX (US)

(73) Assignee: Lennox Manufacturing Inc., Richardson, TX (US)

( * ) Notice: Subject to any disclaimer, the term of this patent is extended or adjusted under 35 U.S.C. 154(b) by 84 days.

(21) Appl. No.: 10/936,278

(22) Filed: Sep. 7, 2004

(65) Prior Publication Data

US 2006/0048535 A1 Mar. 9, 2006

(51) Int. Cl.
*F25D 19/00* (2006.01)

(52) U.S. Cl. ..... 62/296; 181/207; 181/222

(58) Field of Classification Search ..... 62/296; 181/207, 222, 252, 256; 138/26, 28, 118, 138/122

See application file for complete search history.

(56) References Cited

U.S. PATENT DOCUMENTS 2,395,144 A * 2/1946 Stivason ..... 425/403
4,408,467 A * 10/1983 Murnane et al. ..... 62/296
H001317 H * 6/1994 Ng ..... 181/207
5,634,347 A * 6/1997 Hanson et al. ..... 62/120
5,655,367 A * 8/1997 Peube et al. ..... 60/324
6,167,984 B1 * 1/2001 Johansson et al. ..... 181/232
6,655,165 B1 * 12/2003 Eisenhour ..... 62/296

* cited by examiner

*Primary Examiner*—William E. Tapolcai
(74) *Attorney, Agent, or Firm*—W. Kirk McCord

(57) ABSTRACT

A device is provided for dampening compressor-induced vibration in an air conditioning system of the type having an indoor unit, an outdoor unit and a refrigerant conduit therebetween. The outdoor unit includes a compressor that is operable to circulate a vapor compression refrigerant through the conduit between the indoor and outdoor units. The dampening device is comprised of plural vibration dampening elements spaced along the conduit, with the spacing between adjacent elements corresponding to the wavelength of a natural vibratory frequency of the conduit. The device is preferably located proximate to the compressor and inside of the outdoor unit cabinet in which the compressor is housed. Various embodiments of the dampening device are disclosed.

16 Claims, 4 Drawing Sheets

AIR CONDITIONING SYSTEM WITH VIBRATION DAMPENING DEVICE

TECHNICAL FIELD

This invention relates generally to air conditioning systems wherein a vapor compression refrigerant is used to cool air supplied to an indoor space and in particular to a device for dampening compressor-induced vibration in an air conditioning system.

BACKGROUND ART

In central air conditioning systems typically used in residences, a compressor is operable to circulate a vapor compression refrigerant between an indoor heat exchanger and an outdoor heat exchanger. In recent years, scroll-type compressors for the most part have replaced reciprocating-type compressors in residential air conditioning systems. For cost reasons, such scroll-type compressors typically do not include vibration-dampening springs to isolate the motor and compressor mechanism from the outer housing of the compressor. The refrigerant lines on the suction and discharge sides of the compressor are rigidly attached to this outer housing. Therefore, unlike older-style reciprocating compressors, there is a direct vibration transmission path to these refrigerant lines.

In particular the refrigerant line between the indoor heat exchanger and the compressor is susceptible to such vibrations because the line is relatively rigid due its relatively large diameter (e.g., ⅞ inch). In a non-heat pump air conditioning system, where the indoor heat exchanger operates as an evaporator, this refrigerant line corresponds to the compressor suction line, through which vapor refrigerant is drawn from the evaporator to the compressor. The length of such suction line may be about 40 feet, with most of the line being inside the building that is serviced by the air conditioning system. In a heat pump system, this refrigerant line corresponds to the compressor suction line when the system is operated in a cooling mode and to the compressor discharge line when the system is operated in a heating mode.

Such vibrations in the refrigerant line between the compressor and indoor heat exchanger may cause a droning noise that is readily detectable by occupants of the building. This droning noise results when a 120 Hz and/or 240 Hz vibration, which is typically associated with electric motor noise, is modulated by a low frequency (2 Hz or less) standing wave in the refrigerant line, which varies the intensity of the 120 Hz vibration and/or 240 Hz vibration. The standing wave causes displacement of the refrigerant line, such that contact between the line and a wall, floor or other structural component results in points of noise transmission inside the building.

One solution that has been proposed to inhibit such vibrations is to strap one or more strips of rubber around the refrigerant line, which reduces vibration by adding mass to the line and by frictional damping. The length of each rubber strip preferably corresponds to ¼ of the wavelength of the standing wave vibration (e.g., 24 inches). This solution typically is used as a "field fix" after the system installer has received a complaint about noise from a customer. The number of ¼ wavelength rubber strips needed is determined in the field, largely by trial and error. Further, the rubber strips are typically wrapped around sections of the refrigerant line that are external to a cabinet in which the outdoor heat exchanger and compressor are housed.

SUMMARY OF THE INVENTION

In accordance with the present invention, a device is provided for dampening compressor-induced vibration in an air conditioning system of the type having an indoor unit and an outdoor unit. The outdoor unit includes a compressor operable to circulate a vapor compression refrigerant between the indoor and outdoor units via a refrigerant conduit. The device is comprised of plural vibration dampening elements spaced apart along the conduit, with the spacing between adjacent elements corresponding to a wavelength of a compressor-induced natural vibratory frequency of the conduit.

In accordance with one embodiment of the invention, each vibration dampening element is comprised of a flexible member surrounding the conduit and and a relatively rigid sleeve surrounding the flexible member. In accordance with another embodiment of the invention, each of the elements includes a chamber containing plural particles in a relatively densely packed arrangement, whereby each particle is in frictional contact with at least one other particle. In accordance with yet another embodiment of the invention, each of the vibration dampening elements is comprised of plural sections of enhanced flexibility formed in the conduit. In accordance with still another embodiment of the invention, the device includes a tubular member interposed in the conduit to define a part thereof. The vibration dampening elements are spaced along the tubular member.

In accordance with a preferred embodiment of the invention, the device is located inside of a cabinet in which the compressor is housed. When a portion of the conduit inside of the cabinet includes an access component, such as a service valve, the dampening device is preferably located between the compressor and the access component. Further, in a heat pump system having a reversing valve inside of the cabinet between the compressor and service valve, the device is preferably located between the compressor and the reversing valve. Further, the interval between adjacent vibration dampening elements is preferably about one-fourth of the wavelength of the compressor induced natural vibratory frequency of the conduit.

BEST MODE FOR CARRYING OUT THE INVENTION

The best mode for carrying out the invention will now be described with reference to the accompanying drawings. Like parts are marked in the specification and drawings with the same respective reference numbers. In some instances, proportions may have been exaggerated in order to depict certain features of the invention.

Figure 1:
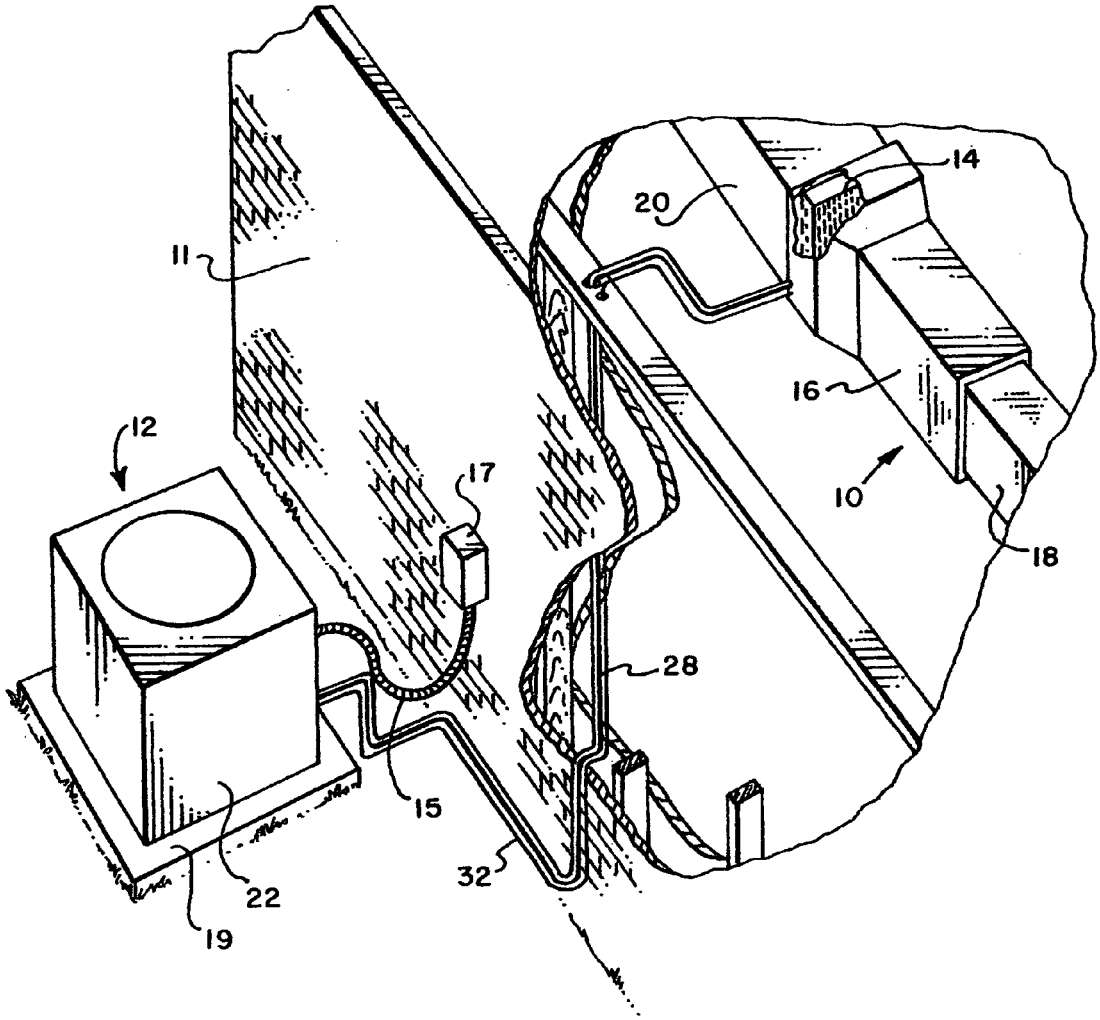
FIG. 1 is a perspective view of a conventional air conditioning system, showing indoor and outdoor portions thereof.

Referring now to FIG. 1, a central air conditioning system of the type used in residences includes an indoor unit 10 inside of a building 11 and an outdoor unit 12 on the outside of building 11. Indoor unit 10 includes a first heat exchanger 14 located inside of an air handler 16, which is coupled between a return air duct 18 and a supply air duct 20. In a non-heat pump system, indoor heat exchanger 14 is operable to cool air being supplied to an indoor space through supply duct 20. In a heat pump system, heat exchanger 14 is operative to cool the supply air when the system is operated in a cooling mode and to heat the supply air when the system is operated in a heating mode. A power cable 15 couples outdoor unit 12 to a power source 17, whereby electrical power is supplied to outdoor unit 12. Outdoor unit 12 includes a concrete support pad 19.

Figure 2:
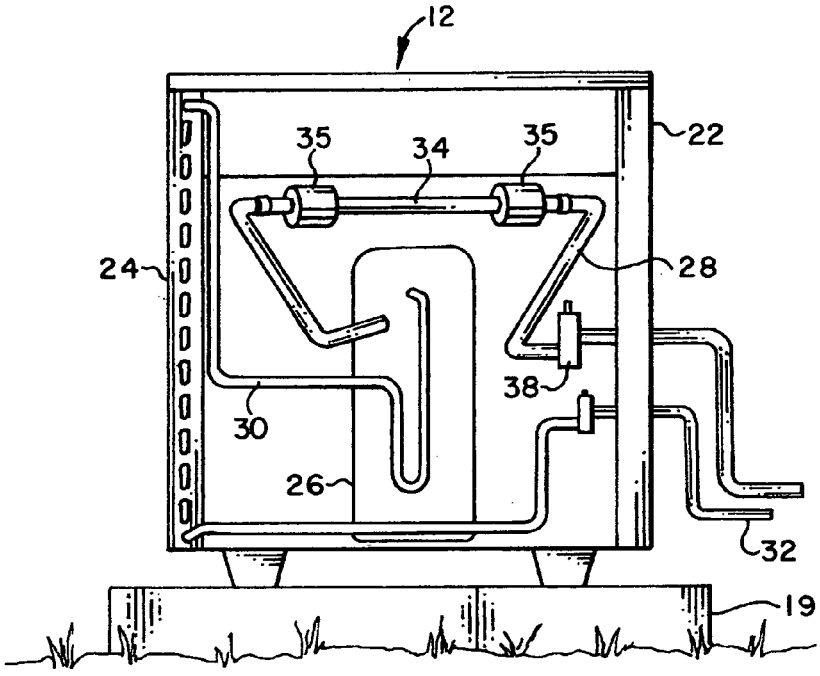
FIG. 2 is an cutaway view of the outdoor portion of the air conditioning system of FIG. 1, showing a first embodiment of a vibration-dampening device, according to the present invention.

Referring also to FIG. 2, outdoor unit 12 includes a cabinet 22, which houses a second heat exchanger 24 and a compressor 26, which is operable to circulate a vapor compression refrigerant between the indoor and outdoor heat exchangers 14, 24 via a refrigerant conduit. The conduit is comprised of a first refrigerant line 28 communicating between first heat exchanger 14 and compressor 26, a second refrigerant line 30 communicating between compressor 26 and second heat exchanger 24 and a third refrigerant line 32 communicating between second heat exchanger 24 and first heat exchanger 14. Lines 28,30,32 are typically made of copper.

One skilled in the art will recognize that in a cooling mode, first heat exchanger 14 operates as an evaporator to cool supply air by transferring heat from the air flowing over the outside of heat exchanger 14 to the refrigerant flowing inside heat exchanger 14, which results in evaporation of the refrigerant. Likewise, second heat exchanger 24 operates as a condenser to condense the evaporated refrigerant by rejecting heat from the refrigerant to outdoor air flowing over the outside of heat exchanger 24. In the cooling mode, first refrigerant line 28 functions as the suction line for compressor 26 and second and third refrigerant lines 30,32 function as discharge lines for compressor 26. However, in the case of a heat pump system operating in a heating mode, the roles of heat exchangers 14,24 are reversed. Heat exchanger 14 operates as a condenser to heat the supply air and heat exchanger 24 operates as an evaporator. A reversing valve, not shown, would be located in line 28. In the heating mode, line 28 would function as the hot gas line from compressor 26 to condenser 14 and line 30 would function as a suction line from evaporator 24 to compressor 26.

As can be best seen in FIG. 1, the respective major portions of first and third refrigerant lines 28,32 are outside of cabinet 22, with only minor portions thereof being inside of cabinet 22, as shown in FIG. 2. Second refrigerant line 30 is entirely within cabinet 22, as shown in FIG. 2. The distance between indoor and outdoor units 10, 12 is typically on the order of 40 feet, so that the length of first and third refrigerant lines 28,32 is each about 40 feet. First refrigerant line 28 usually has a larger diameter than second and third refrigerant lines 30, 32 (e.g., ⅞ inch vs. ⅜ inch). As a result, first refrigerant line 28 is more rigid than second and third refrigerant lines 30,32, which makes first line 28 more prone to transmitting compressor-induced vibrations inside building 11 than second and third refrigerant lines 30,32. Further, line 28 is rigidly in contact with the outer housing of compressor 26 so that vibrations from operation of compressor 26 are transmitted directly through the compressor housing to refrigerant line 28.

As previously mentioned, such vibrations are typically associated with the vibration from the electric motor (not shown) that operates compressor 26. Such noise may include one or both of 120 Hz and 240 Hz vibrations, modulated by a low frequency (2 Hz or less) standing wave in first refrigerant line 28. The modulation produces a droning noise of varying intensity inside building 11 when the vibration of line 28 causes contact with walls or other structural components of building 11. This droning noise is readily detectable by occupants of building 11.

Figure 3:
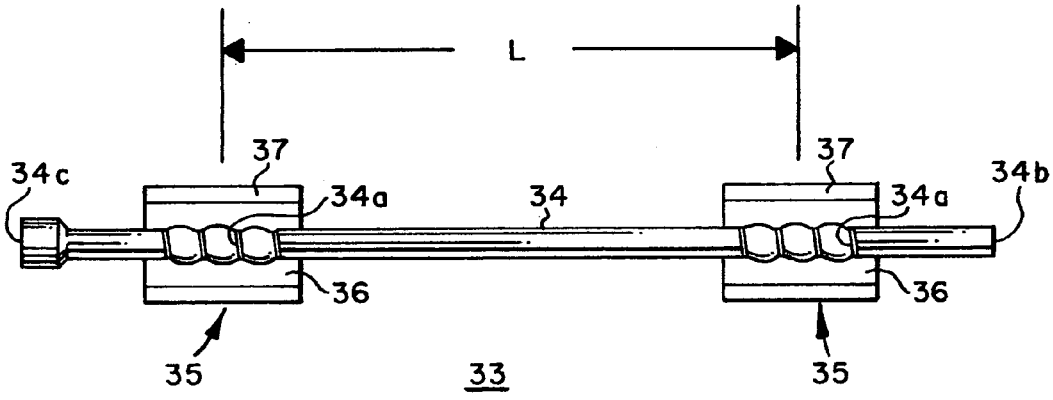
FIG. 3 is a sectional view of the first embodiment of the vibration-dampening device.

In accordance with the present invention, a device for dampening compressor-induced vibrations is provided. In accordance with a first embodiment of the invention, as shown in FIGS. 2 and 3, device 33 is comprised of a tubular member 34 and plural vibration dampening elements 35. Each element 35 includes a flexible member 36 surrounding a portion of tubular member 34 and in contact therewith, and a relatively rigid sleeve 37 surrounding the corresponding flexible member 36 and in contact therewith, such that the flexible member 36 and corresponding sleeve 37 are in concentric relationship with tubular member 34. Device 33 is interposed in line 28 between compressor 26 and a service valve 38 and is located inside cabinet 22, as shown in FIG. 2, such that tubular member 34 defines a part of line 28.

In the case of a heat pump system, wherein the reversing valve (not shown) would be located in line 28 between compressor 26 and service valve 38, device 33 would be located between compressor 26 and the reversing valve. The portion of tubular member 34 surrounded by each element 35 has plural convolutions 34*a* to enhance the flexibility of tubular member 34. These convolutions may be formed by inserting an expanding roller into tubular member 34 after elements 35 are fitted over tubular member 34, so that convolutions 34*a* "lock" each element 35 into snug-fit engagement with tubular member 34. Although two elements 35 are shown in FIGS. 2 and 3, one skilled in the art will recognize that device 33 may include more than two elements 35.

Tubular member 34 has a male end 34*b* and a swaged female end 34*c* for connecting tubular member 34 to a section of line 28 between service valve 38 and compressor 26, such that tubular member 34 forms a part of first refrigerant line 28. Tubular member 34 is preferably made of the same material as line 28 and has the same diameter. For example, if line 28 is a copper tube with a ⅞ outer diameter, tubular member 34 is also a copper tube with a ⅞ inch outer diameter. Each flexible member 36 is preferably an elastomeric material such as rubber. Each sleeve 37 is preferably made of steel or iron.

The spacing L between adjacent elements 35 corresponds to the wavelength of a compressor-induced natural vibratory frequency of line 28 and is preferably about ¼ of the wavelength of the natural vibratory frequency, which allows the full amplitude of the vibration to be dampened. For example, if line 28 is a ⅞ inch diameter copper tube, the compressor-induced natural vibratory frequency may have a wavelength of about eight feet, so that the spacing L would be about two feet. Alternatively, in lieu of interposing a tubular member into line 28, elements 35 could be spaced along line 28 in concentric relationship therewith. In that case, line 28 could include corrugations associated with each element 35 to lock elements 35 in place on line 28.

In operation, device 33 dampens compressor-induced vibrations by (i) adding mass to line 28; (ii) increasing the flexibility of line 28 due to convolutions 34*a*; and frictionally damping vibrations by means of the snug-fit contact between elements 35 and tubular member 34. The frictional damping provided by flexible members 36 is enhanced by its snug-fit engagement with both tubular member 34 and the corresponding sleeve 37.

Figure 4:
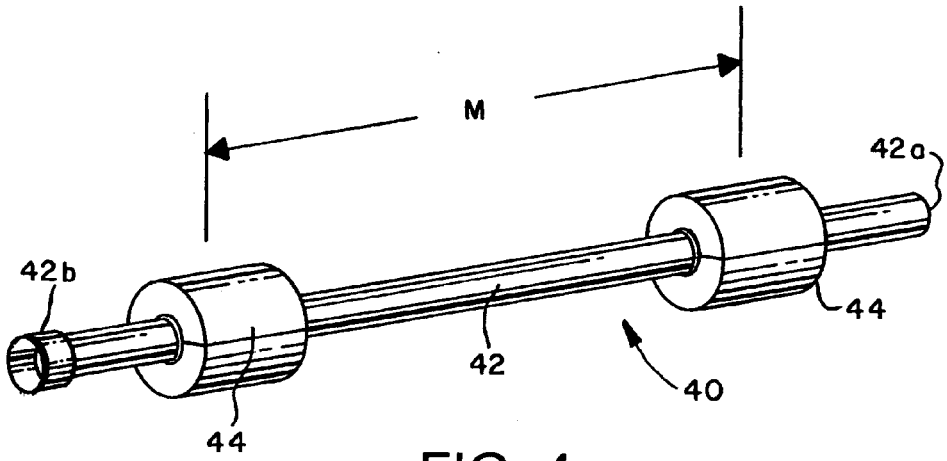
FIG. 4 is a perspective view of a second embodiment of a vibration-dampening device, according to the present invention.
Figure 5:
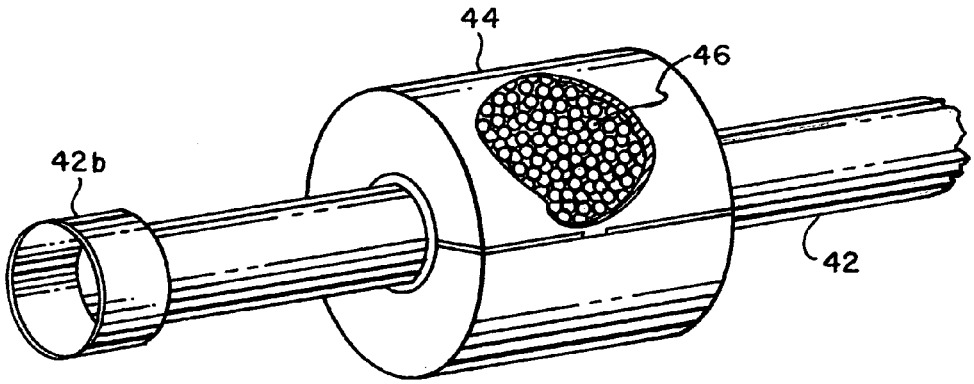
FIG. 5 is a perspective view of one of the elements of the second embodiment of the vibration-dampening device, a portion of which is cut away to show the interior thereof.

In accordance with a second embodiment of the invention, as shown in FIGS. 4 and 5, a dampening device 40 is comprised of a tubular member 42 with plural weighted elements 44 at predetermined intervals therealong and in concentric relationship therewith, as shown in FIGS. 4 and 5. Tubular member 42 is made of the same material (e.g., copper) as first refrigerant line 28 and has the same outer diameter (e.g., ⅞ inch). Tubular member 42 has a male end 42*a* and a swaged female end 42*b* to facilitate connection of device 40 in line 28, in the same manner as device 33 described hereinabove, such that tubular member 42 forms a part of line 28. Each weighted element 44 has a chamber containing plural particles 46 in a relatively densely packed arrangement, as shown in FIG. 5, whereby each particle 46 is in frictional contact with at least one other particle 46 and preferably with a plurality of other particles 46. Alternatively, in lieu of interposing a tubular member into line 28, elements 44 could be spaced along line 28 in concentric relationship therewith.

When used in an air conditioning system, device 40 would be connected in line 28 between compressor 26 and service valve 38, inside cabinet 22, in the same manner as shown in FIG. 2 for device 33. Further, in the case of a heat pump system, device 40 would be located between compressor 26 and the reversing valve.

The interval M between adjacent ones of the weighted elements 44 as best shown in FIG. 4, corresponds to the wavelength of a compressor-induced natural vibratory frequency of first refrigerant line 28. Preferably, the interval M is about ¼ of the wavelength of the natural vibratory frequency, which allows the full amplitude of the vibration to be dampened. For example, if line 28 is a ⅞ inch diameter copper tube, the compressor-induced natural vibratory frequency may have a wavelength of about eight feet, so that the interval M between adjacent ones of weighted elements 44 would be about two feet. Although two weighted elements 44 are shown in FIG. 4, one skilled in the art will recognize that device 40 may include more than two weighted elements 44. In operation, device 40 dampens compressor-induced vibrations by (i) adding mass to line 28 and (ii) dissipating vibrations by frictional contact among particles 46 in each weighted element 44.

Figure 6:
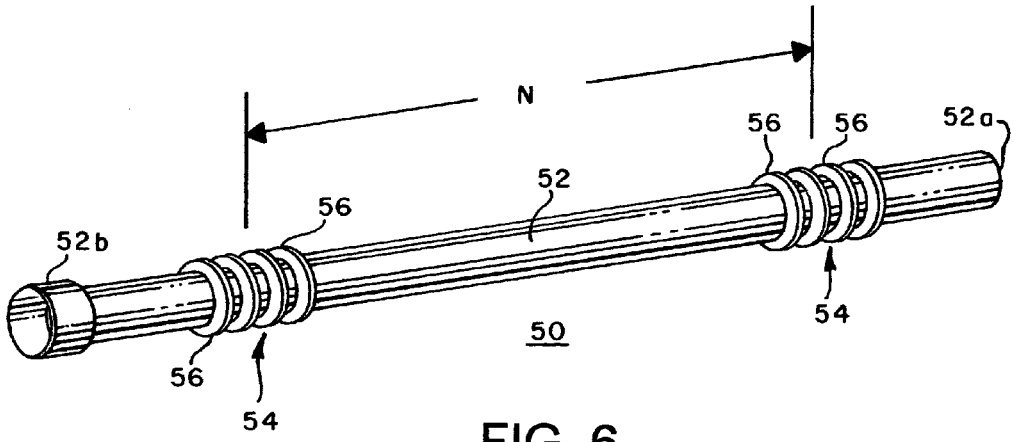
FIG. 6 is a perspective view of a third embodiment of a vibration-dampening device, according to the present invention.

In accordance with a third embodiment of the invention, as shown in FIG. 6, a dampening device 50 is comprised of a tubular member 52 having plural sections 54 of enhanced flexibility spaced along tubular member 52. Each section 54 is comprised of plural corrugations 56, which defines a bellows in tubular member 52, to enhance the flexibility thereof. Tubular member 52 is preferably made of the same material (e.g., copper) as first refrigerant line 28 and has the same outer diameter (e.g., ⅞ inch). Tubular member 52 has a male end 52*a* and a swaged female end 52*b* to facilitate connection of device 50 in line 28, in the same manner as device 33 and device 40 described hereinabove, such that tubular member 52 forms a part of line 28. When used in an air conditioning system, device 50 would be connected in line 28 between compressor 26 and service valve 38, inside cabinet 22, in the same manner as shown in FIG. 2 for device 33. Further, in the case of a heat pump system, device 50 would be located between compressor 26 and the reversing valve. Alternatively, in lieu of interposing a tubular member into line 28, bellows sections 54 could be formed in line 28 at spaced intervals therealong.

The interval N between adjacent ones of bellows sections 54 corresponds to the wavelength of a compressor-induced natural vibratory frequency of first refrigerant line 28. Preferably, the interval N is about ¼ of the wavelength of the natural vibratory frequency, which allows the full amplitude of the vibration to be dampened. For example, if line 28 is a ⅞ inch diameter copper tube, the compressor-induced natural vibratory frequency may have a wavelength of about eight feet, so that the interval N between adjacent ones of bellows sections 54 would be about two feet. Although two bellows sections 54 are shown in FIG. 6, one skilled in the art will recognize that device 50 may include more than two sections 54. Further, although four corrugations 56 are shown in each section 54 in FIG. 6, one skilled in the art will recognize that one of sections 54 may include more or fewer than four corrugations 56. Device 50 dampens compressor-induced vibrations in first refrigerant line 28 primarily by increasing the flexibility of line 28.

The dampening device according to the present invention is preferably incorporated into the outdoor unit of an air conditioning system by the manufacturer, thereby reducing the need for "field fixes" of compressor-induced noise problems by system installers and service personnel. The best mode for carrying out the invention has now been described in detail. Since changes in and modifications to the above-described best mode may be made without departing from the nature, spirit and scope of the invention, the invention is not to be limited to the above-described best mode, but only by the appended claims and their equivalents.

The invention claimed is:

1. An air conditioning unit, comprising:

a refrigerant line;

a compressor for compressing a vapor compression refrigerant and circulating the refrigerant through said line; and a device for reducing compressor-induced vibration in said line, said device including a plurality of vibration-dampening elements spaced along at least a portion of said refrigerant line, each of said elements being spaced apart from an adjacent element at an interval corresponding to a wavelength of a natural vibratory frequency of said line, wherein each of said elements is comprised of a flexible member and a rigid sleeve in concentric relationship with said line, said flexible member surrounding said line and said rigid sleeve surrounding said flexible member.

2. The unit of claim 1 wherein said line includes plural convolutions associated with each of said elements.

3. The unit of claim 1 wherein said device includes a tubular member interposed in said line and defining a portion thereof, said plurality of elements being spaced along said tubular member, said flexible member surrounding said tubular member and said rigid sleeve surrounding said flexible member.

4. The unit of claim 3 wherein said tubular member includes plural convolutions associated with each of said elements.

5. The unit of claim 1 wherein said interval corresponds to about one-fourth of the wavelength of said compressor-induced natural vibratory frequency.

6. The unit of claim 1 further including a cabinet, said compressor and said vibration-dampening elements being located in said cabinet.

7. The unit of claim 1 further including a first heat exchanger and a second heat exchanger, said refrigerant line interconnecting said compressor with said first and second heat exchangers, said compressor being operable to draw refrigerant from said first heat exchanger through a first portion of said refrigerant line and to discharge refrigerant to said second heat exchanger through a second portion of said refrigerant line, said plurality of vibration-dampening elements being spaced along said first portion of said refrigerant line.

8. An air conditioning unit, comprising:

a refrigerant line;

a compressor for compressing a vapor compression refrigerant and circulating the refrigerant through said line; and a device for reducing compressor-induced vibration in said line, said device including a plurality of vibration-dampening elements spaced along at least a portion of said refrigerant line, each of said elements being spaced apart from an adjacent element at an interval corresponding to a wavelength of a natural vibratory frequency of said line, wherein each of said elements is in concentric relationship with said line and has a chamber containing plural particles in a relatively densely packed arrangement, whereby each particle is in contact with at least one other particle.

9. The unit of claim 8 wherein said device includes a tubular member interposed in said line and defining a portion thereof, said plurality of elements being spaced along said tubular member and in concentric relationship.

10. The unit of claim 8 further including a cabinet, said compressor and said vibration-dampening elements being located in said cabinet.

11. The unit of claim 8 further including a first heat exchanger and a second heat exchanger, said refrigerant line interconnecting said compressor with said first and second heat exchangers, said compressor being operable to draw refrigerant from said first heat exchanger through a first portion of said refrigerant line and to discharge refrigerant to said second heat exchanger through a second portion of said refrigerant line, said plurality of vibration-dampening elements being spaced along said first portion of said refrigerant line.

12. An air conditioning unit, comprising:

a refrigerant line;

a compressor for compressing a vapor compression refrigerant and circulating the refrigerant through said line; and a device for reducing compressor-induced vibration in said line, said device including a plurality of vibration-dampening elements spaced along at least a portion of said refrigerant line, each of said elements being spaced apart from an adjacent element at an interval corresponding to a wavelength of a natural vibratory frequency of said line, wherein each of said elements is comprised of plural sections of enhanced flexibility formed in said line.

13. The unit of claim 12 wherein each of said sections is comprised of plural corrugations to enhance the flexibility of said line.

14. The unit of claim 12 wherein said device includes a tubular member interposed in said line and defining a portion thereof, said plurality of elements being formed in said tubular member.

15. The unit of claim 12 further including a cabinet, said compressor and said vibration-dampening elements being located in said cabinet.

16. The unit of claim 12 further including a first heat exchanger and a second heat exchanger, said refrigerant line interconnecting said compressor with said first and second heat exchangers, said compressor being operable to draw refrigerant from said first heat exchanger through a first portion of said refrigerant line and to discharge refrigerant to said second heat exchanger through a second portion of said refrigerant line, said plurality of vibration-dampening elements being spaced along said first portion of said refrigerant line.

* * * * *